United States Patent [19]

Reeder

[11] Patent Number: 4,656,453

[45] Date of Patent: Apr. 7, 1987

[54] CARTRIDGE FUSE WITH TWO ARC-QUENCHING END PLUGS

[75] Inventor: Conrad M. Reeder, Prospect Heights, Ill.

[73] Assignee: Littelfuse, Inc., Des Plaines, Ill.

[21] Appl. No.: 807,263

[22] Filed: Dec. 10, 1985

Related U.S. Application Data

[63] Continuation-in-part of Ser. No. 448,313, Dec. 9, 1982, Pat. No. 4,563,809.

[51] Int. Cl.[4] ..... H01H 85/16

[52] U.S. Cl. ..... 337/236; 337/238; 337/278

[58] Field of Search ..... 29/623; 337/202, 227, 337/228, 231, 233, 234, 236, 248, 252, 253, 278, 238

[56] References Cited

U.S. PATENT DOCUMENTS 1,562,985 11/1925 Murray ..... 337/234

3,354,282 11/1967 Batsch ..... 337/234

3,460,086 8/1969 Fister ..... 337/202

3,529,270 9/1970 Kozacka ..... 337/248

4,075,755 2/1978 Bernatt et al. ..... 29/623

*Primary Examiner*—Percy W. Echols

*Attorney, Agent, or Firm*—Russell E. Hattis; Lawrence J. Bassuk

[57] ABSTRACT

A cartridge fuse has a pair of compressed, resilient plugs in opposed ends of a passageway passing through the fuse housing. The compressed material of the plugs engages and holds the fuse filament in slight tension along the length of the passageway and provide unexpectedly superior arc-quenching qualities to prevent explosion of the fuse housing. The ends of the fuse filament can be engaged through the centers of the plugs axially to align the fuse filament in the housing or the fuse filament ends can be engaged between the plugs and the interior of the housing wall to align the fuse filament under tension diagonally in the housing.

5 Claims, 7 Drawing Figures

CARTRIDGE FUSE WITH TWO ARC-QUENCHING END PLUGS

RELATED APPLICATION

This application is a continuation-in-part of application Ser. No. 448,313 filed Dec. 9, 1982, now U.S. Pat. No. 4,563,809.

BACKGROUND OF THE INVENTION

This invention has its most important application in miniature electrical cartridge fuses of the type having a centered fuse filament extending through a cylindrical, insulating housing closed by terminal-forming end caps. Some aspects of the invention, however, are applicable to fuses having a fuse filament extending diagonally across the housing.

Among the generally desired objectives in the design and manufacture of cartridge fuses are suspending a fuse filament within a desired range of tensions, soldering the same between opposed end caps in a reliable and efficient manner, minimizing the physical size of the fuse for a certain electrical rating, and maximizing protection against explosion, which can occur when the fuse filament opens or "blows" during high current, high voltage short circuit conditions that produce high energy arcs across the separated fuse filament parts. Such an arc, if unchecked, can extend to the end caps and cause an explosion. These objectives, however, are not always compatible. For example, an arc occurring in a physically small fuse can more readily spread to the end caps and create an explosion hazard than in a physically larger fuse.

One of the most common and simplest, but least reliable, ways to make a miniature cylindrical cartridge fuse is to position the fuse filament diagonally disposed across the length of the cylindrical housing and captively secure the ends of the fuse filament between the housing and the end caps. The physical and electrical attachment of the fuse filament to the end caps and of the end caps to the housing are obtained by melting a solder pellet placed in each end cap. The solder is generally drawn by capillary action into the small clearance space between the end caps and housing to anchor and seal the end caps while electrically connecting the fuse element ends to the end caps.

The blowout characteristics of such fuses having angled filaments tend to vary an undesired degree from fuse to fuse because, as the operating currents slowly rise to the melting temperature of the fuse filament, the resulting expansion or relaxation of the angled fuse filament can cause portions thereof, which are near but spaced from the housing walls, to sag and touch portions of the walls of the housing. This touching modifies the desired opening or blowing characteristics of the fuse due to the heat sinking effect of the housing walls. The degree to which each fuse filament sags and the degree to which the fuse blowing characteristics of each fuse are modified can vary substantially from fuse to fuse. Further, in the manufacturing process a delicate balance must be struck between applying enough tension to the fuse filament during the attachment process, to minimize sag, without over-stressing the fuse filament, which can produce undesired weakening of the fuse filament or the stretching thereof and also modifies the fuse blowing characteristics.

There are circumstances, however, when the fuse filament desirably extends diagonally across the housing. One such circumstance is dictated by market demand for a familiar product. Another is where a manufacturer does not possess equipment and know-how to manufacture axial mounted fuse filaments. In this last situation, the possible sagging is simply accepted or where an arc-quenching, filler material is desirable it is packed inside the housing and around the fuse filament to support the filament and prevent sagging thereof.

A better approach for making miniature fuses is to use a design with a fuse filament centered in the fuse housing. Such a disposition of the fuse filament, however, while inherently more reliable than a diagonally extending fuse filament, is more difficult to assemble and, as in the case of fuses with diagonal fuse filaments, the tension in the fuse filaments thereof is not readily closely controlled. In one process of fuse assembly, the fuse housing has end caps with centered holes therein, and a fuse filament carried by an insertion pin is passed through the fuse housing and the centered openings of the end caps. An operator then solders the fuse filament to the outer surfaces of the end caps with the fuse filament under manually applied tension. Since it is difficult for a person accurately to control the degree of tension applied to the fuse filament, in some cases inadequate tension and in the other cases excessive tension was applied which either broke the filament or unduly stretched the same, so as to undesirably modify the fuse blowing characteristics thereof. A cartridge fuse thus should be arranged easily to select the tension for the fuse filament.

Means for quenching an arc in a cartridge fuse is known. U.S. Pat. No. 3,179,773 to Keeley, discloses the use of a single arc-quenching plug formed around the fuse filament co-axially supporting only one end portion of a fuse filament extending centrally through a fuse housing. The plug prevents the arc from following the burned filament into the plug body. The plug serves no tension control function, and the other end of the fuse filament simply exits the housing end cap. When an arc reaches the point where the plug surrounds the fuse filament the material of the plug acts as an arc quenching medium but does not collapse around the burning fuse filament to quench the arc. Also, it has heretofore been routinely believed that the use of a single plug would be an adequate arc-quenching, preventive means, since the interruption of an arc at any one point interrupts the entire arc. However, the arc must reach the plug before it reaches the end cap to be effective.

U.S. Pat. No. 3,227,844 to Burrage et. al. discloses a fuse with a fuse filament passing centrally through the fuse housing and loosely through passages of a pair of insulating plugs disposed at the ends of the fuse housing so that the plugs perform no tension control or arc-quenching function since the plugs do not collapse upon the fuse filament. The fuse filament is bent over the insulating end plugs to be secured to subsequently inserted end caps by soldering, spot welding or the like. A separate filler material provides arc-quenching characteristics. The walls of the passages through the end plugs are shown spaced from the fuse filament so that, apparently, the insulating end plugs cannot hold the fuse filament in tension.

U.S. Pat. No. 4,158,187 to Perreault discloses a fuse having a diagonal or angled fuse filament. Filler material is packed inside the housing around the length of the fuse filament to quench any arc and support the filament against sagging. The end caps are attached to the housing by annular portions deformed into annular grooves in the fuse housing. The end caps are biased to a substantially fixed position relative to the annular grooves by special, resilient disk-like members compressed between the rims of the housing and the inner surfaces of the caps. The disk-like members thus provide a longitudinal force between the housing and end caps to maintain the end caps in position and reduce the depth of deformation required to attach the end caps to the housing.

The disk-like members are completely external of the housing and although there is some compression of the ends of the fuse filament between the disk-like members and the end rims of the housing, the disk-like members apparently provide no tension support of the fuse filament. This occurs because in the manufacturing procedure the ends of the fuse filament must be fixed in folded position over the rims of the housing and are free standing before the disk-like members and end caps can be fixed in place. Moreover, the two compression forces of the disk-like members against the fuse filament ends can have no effective arc-quenching action because they press against the fuse filament only for a very short length thereof and the compression points are located at the very location of the end caps from which the arc must be isolated.

SUMMARY OF THE INVENTION

One aspect of the invention provides a cartridge fuse having means in the form of a pair of opposed end plugs that provide both desired tension control of a centered or diagonal fuse filament suspended therebetween and superior arc-quenching characteristics. (Cartridge fuse embodiment in which the fuse element is contained completely within the end caps and to be disclosed as the best mode embodiments of the present invention, while coming under the generic aspects of the invention, are a species thereof invented by other than the present inventor). The centered fuse filament construction may be produced by the unique method of parent application Ser. No. 448,313, previously referenced now U.S. Pat. No. 4,563,809.

Both cartridge fuses include a tubular housing made of insulating material and having a central passageway therethrough. A pair of opposed resilient end plugs are mounted in the passageway at the opposite ends of the housing. In the centered fuse filament embodiment, the fuse filament extends between the end plugs and therebeyond with end portions of the fuse filament passing through passages in the end plugs that snugly engage the fuse filament to maintain a desired, longitudinal tension therein. In the fuse with the diagonal fuse filament, the ends of the fuse filament pass between the sides of the plugs and the inside of the walls of the housing with the sides of the plugs snugly engaging the fuse filament and pressing it against the housing walls to maintain a desired longitudinal tension therein.

Typically the end plugs are compressed into the ends of the central passageway and around the ends of the fuse filament extending from the central passageway. The fuse filament thus can be properly tensioned within the housing with the lateral compression force of the end plugs maintaining the axial filament tension. In the preferred form of the invention, the fuse filament, end plugs and housing are assembled before the end caps are applied. This simplifies manufacturing of the fuse.

Additionally, the pair of end plugs provide unexpectedly superior arc-quenching qualities over the use of one end plug. In one test, the pair of end plugs provided explosion protection for up to twenty (20) times the electrical current flow that caused an explosion in a fuse having only one end plug. The superior arc-quenching qualities are believed provided by the compressed material of the plugs expanding completely behind the stub of the fuse filament as the arc burns into the body of the plug along the plug passages. The expanding plug passage walls seal the passage and quench the arc before the arc reaches the end caps located well beyond the points where the end plugs are located within the housing. (In the Burrage et al. fuse described previously, the end plugs are located beyond the ends of the housing where arc-quenching and tension control functions cannot be effectively carried out.)

In the centered fuse filament version of the invention it is preferred that, the ends of the fuse filament are folded over the outer surfaces of the end plugs before the end caps are assembled therewith. In this and the diagonal filament version of the invention, the end caps and the resilient end plugs close the housing ends and form between them small chambers containing the fuse filament ends and solder that has been melted to connect the tips to the interior surfaces of the end caps. Again, the fuse filament tension is maintained by the end plugs and is unaffected by mounting the end caps on the housing.

In the diagonal fuse filament species of the invention, the fuse filament is diagonal in the housing and the ends of the fuse filament are engaged compressed between the external surfaces of the end plugs and the interior surface of the housing defining the central passageway, rather than passing through the end plugs. The end tips of the fuse filament are folded over the ends of the end plugs and are contained in small chambers formed between the end caps and the end plugs. The chambers are filled with solder to connect the tips to the end caps. Again, the fuse filament axial tension is maintained by the end plugs and is unaffected by mounting the end caps on the housing.

In the less desirable form of the invention disclosed in said parent application Ser. No. 448,313, now U.S. Pat. No. 4,563,809 the end tips of the fuse filament exit through holes in the end caps, with the tips of the fuse filaments being affixed by conventional means, such as solder, to the exterior surfaces of the individual end caps without any need or concern to stress the fuse filament during the soldering operation, since the stress on the critical center portion of the fuse filament is fixed by the holding action of the resilient end plugs.

Other advantages and features of the invention will become apparent upon making reference to the specification, claims, and drawings to follow.

DESCRIPTION OF THE INVENTION

Figure 1:
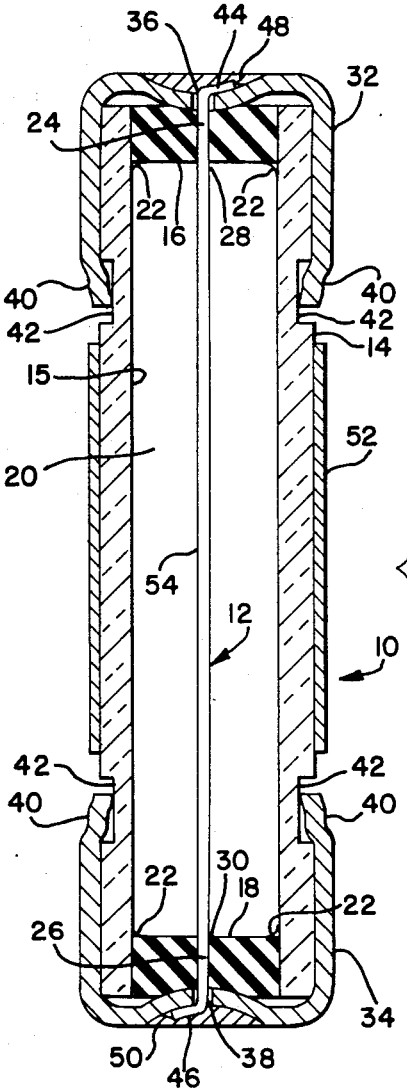
FIG. 1 is a median sectional view of an assembled cartridge fuse constructed and arranged according to the invention.

In FIG. 1, a cartridge fuse constructed and arranged according to the invention is indicated generally by the reference character 10. Cartridge fuse assembly 10 comprises a central fuse filament 12 coaxially disposed in a cylindrical fuse housing 14. Two resilient cylindrically configured end plugs 16 and 18 are secured at either end of a linear central passageway 20 of the housing 14, preferably by adhesive means indicated by fillets 22, so as to be sealed to the interior surfaces 15 of the housing 14 defining the passageway 20. In the preferred embodiment of the invention the end plugs 16 and 18 are made of silicone rubber sealed to the interior surfaces forming the passageway 20 by silicone rubber cement. Alternatively, end plugs 16 and 18 are compressed when placed in position with the resilience of the material thereof effecting seals to the interior surface 15 of the housing 14 defining passageway 20.

The ends 24 and 26 of the fuse filament 12 are held captively secured, with a light tension effected along the length of filament 12, in central passages 28 and 30 of plugs 16 and 18 by the lateral compressed resilience of the plug material engaging against the fuse for an appreciable length thereof. Two cylindrical conducting end terminal caps 32 and 34, each having a central passage 36 and 38, are secured to the fuse housing 14 by means of integral shoulders 40 extending inward to engage circumferential retaining grooves 42 on the outer surface of the fuse housing. The end tips 44 and 46 of fuse filament 12 pass loosely through the end cap passages 36 and 38 with the end tips 44 and 46 being folded over the end caps 32 and 34 to be secured to each, most preferably by solder means exemplified by fillets 48 and 50. A label 52 secured to the outer surface of the fuse housing 14 is attached for purposes of bearing the amperage and voltage rating legends characterizing the fuse.

The resulting cartridge fuse 10 thus holds the fuse filament 12 centrally aligned down the linear passageway 20 sealed by the end plugs 16 and 18, the end plugs also providing the total tensile support for the central region 54 of the fuse filament. Since the fuse tips 44 and 46 exit through loosely fitting end cap passages 36 and 38 to be secured to the end caps 32 and 34, no undue stress is placed on the fuse element during the lead attachment process, thereby improving manufacturing yields and preserving a high degree of alignment. The region of the passageway 20 between the end plugs 16 and 18 can be filled as desired with such as a chosen gas, or with suitable filler materials such as powdered silica or powdered gypsum.

Figure 2:
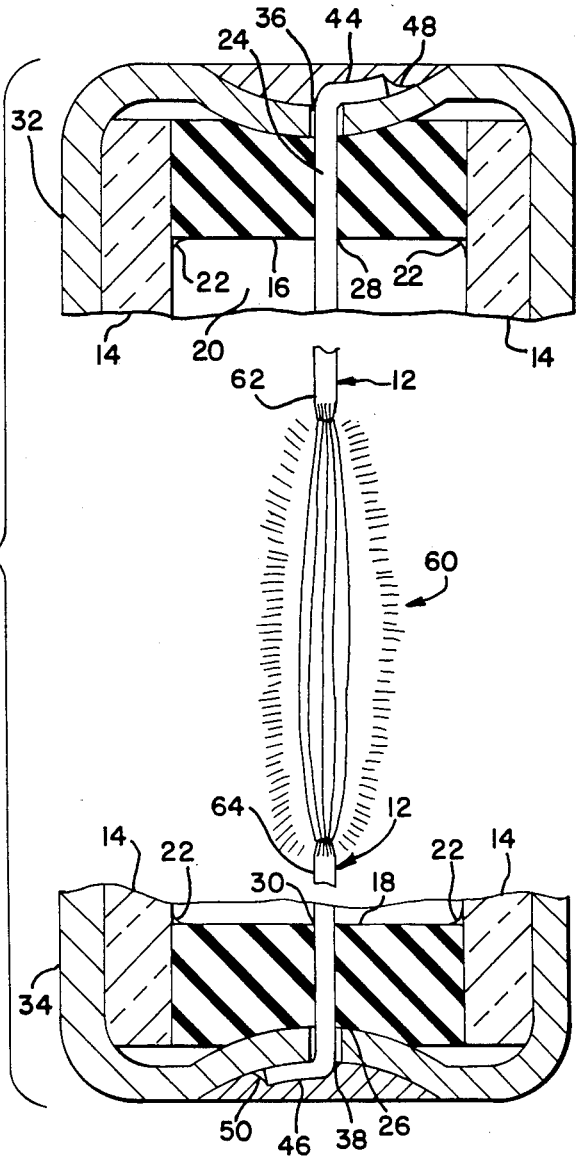
FIG. 2 is a fragmentary median sectional view, on an enlarged scale, of the fuse of the invention in the region of the end caps thereof, with an arc shown disposed therebetween.

In FIG. 2, fuse 10, diagrammatically shown for illustration purposes, has been subjected to an electrical overload resulting in the creation of an electrical arc 60 extending across from fuse element stub 62 to fuse element stub 64 of the previously contiguous fuse element 12. This has occurred according to relatively well known parameters of such as high current and voltage overload of the fuse. This arcing condition, if the arc 60 is not quenched within a certain time, can result in dangerous explosion of the fuse housing 14.

Figure 3:
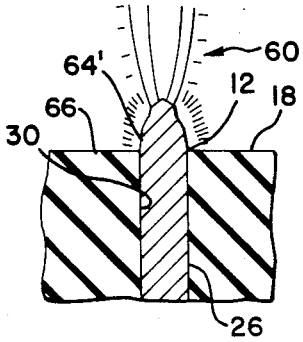
FIG. 3 is a fragmentary sectional view of the fuse, on an enlarged scale, in the region of a fuse element protruding from an end plug, before the arc burns the fuse element below the body of the plug.

In FIG. 3, the arc 60 has burned or vaporized sufficient length of the fuse filament material for the stub 64', from which one end of the arc 60 emanates, to be at the top surface 66 of end plug 18. The other stub 62 is also burned to approximately the same relative position at the interior surface of end plug 16, so that arc 60 extends substantially from end plug 16 to end plug 18.

Figure 4:
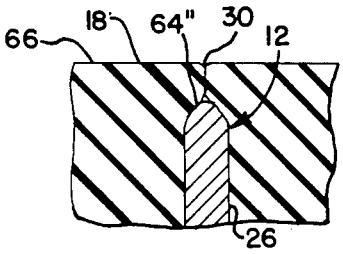
FIG. 4 is a view similar to that of FIG. 3 after the arc has burned the fuse element a distance below and into the end plug.

In FIG. 4, arc 60 has burned the fuse filament 12 down into passage 30 sufficiently for the stub 64" to be wholly below top surface 66 of plug 18 and to be at a level within the body of plug 18. Plug 18 is made of a resilient material and has been compressed at passage 30 around fuse filament 12 upon assembly of the fuse 10. Upon removal of fuse filament material by burning effected by arc 60, the resilient material of plug 18 expands to fill the space in passage 30 previously filled by the fuse filament material. This closes the free space in passage 30 between the stubs 62 and 64, in which the arc has existed, and quenches the arc. A like effect occurs at plug 16 and passage 28.

The invention provides an insulating resilient plug 16 and 18 at the respective ends of the structure, and provides a narrow fuse filament passage 28 and 30 in the respective plugs, which allows each plug closely to hug or engage the fuse filament. This obtains an unexpected improvement in arc-quenching characteristics over more conventional fuse structures, such as shown in the previously mentioned Keeley patent, wherein only one end of a fuse element is so confined.

Various arc-quenching means have been routinely applied to miniature fuses, such as filling the same with sand or other materials, or using a single resilient plug as in said Keeley patent. Viewed analytically, it should be necessary to quench the arc at only one point, since breaking the electrical circuit at any point extinguishes the arc. Thus, providing a fuse with only one such constricting passage at one end of the structure should be sufficient to obtain the desired quenching action and be sufficient to prevent explosive failure of such a fuse.

Experimentally, however, a completely different effect has been observed. Cartridge fuses with a single constricting passage at one end failed disastrously and with explosive violence under test at 625 volts at a current of 10,000 amperes. It was unexpectedly discovered that fuses provided with confining plugs at both ends of the fuse, as shown in FIG. 1, will routinely withstand up to 200,000 amperes without explosion under similar test conditions. Accordingly, a principal feature of the present invention is the provision of two such plugs, one at either end of a captive fuse element.

Figure 5:
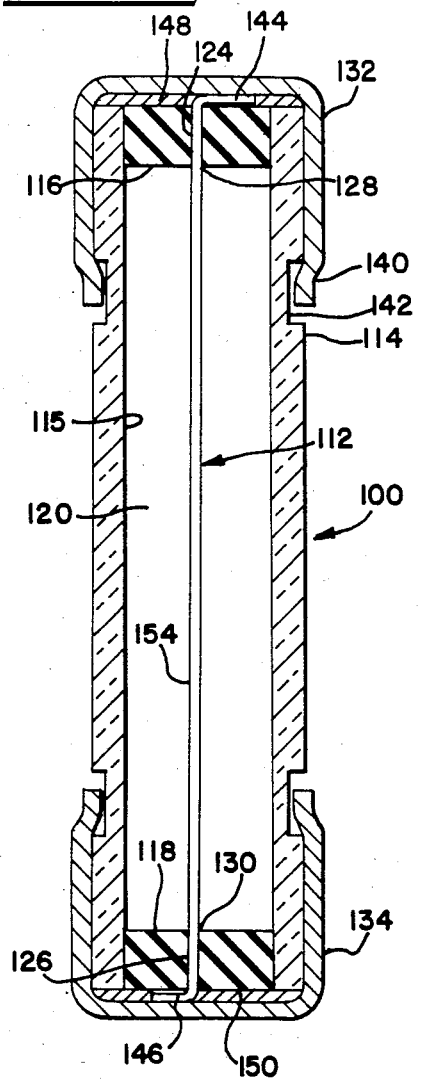
FIG. 5 is a median sectional view of a cartridge fuse constructed and arranged according to a second and preferred centered filament species of the invention.

In FIG. 5, the invention presents an alternative species in the structure of cartridge fuse 100. Fuse 100 comprises a central fuse filament 112 coaxially disposed in a cylindrical fuse housing 114. The interior surface 115 of housing 114 defines a central linear passageway 120 having two ends in which are secured two resilient cylindrically configured end plugs 116 and 118. Plugs 116 and 118 are secured in housing 114 by any means desired, such as by compression of the material thereof, gluing, etc..

The ends 124 and 126 of the fuse filament 112 are held captively secured in passages 128 and 130 through the plugs by the resilient lateral compression of the plug material engaging against the fuse ends for an appreciable length thereof. The compression of the fuse filament ends 124 and 126 is used to maintain a light tension along the length of fuse filament 112 between plugs 116 and 118. Two cup-like, cylindrical conducting end terminal caps 132 and 134 are secured to the housing 114 by a mechanical engagement of shoulders 140 and retaining grooves 142.

The ends 124 and 126 of fuse filament 112 pass through the plug passages 128 and 130 and terminate in tips 144 and 146 folded at right angles over the outer surfaces of plugs 116 and 118. End caps 132 and 134 close the ends of housing 114 to leave small chambers 148 and 150 that are filled with solder to connect the fuse filament tips 144 and 146 to the end caps 132 and 134.

This embodiment retains the fuse filament 112 centrally aligned along the linear passageway 120 and sealed by end plugs 116 and 118. The end plugs also provide the total tensile support for the central region 154 of the fuse filament. The fuse tips 144 and 146 are contained in the chambers 148 and 150 during the end cap attachment process and thus the arrangement avoids placing undue stress on the fuse element during the lead attachment process. This improves manufacturing yields and preserves a high degree of alignment. The space in passageway 120 between the end plugs 116 and 118 can be filled as desired.

Again, the substantially increased protection against explosion is obtained in the arrangement of fuse 100 by the resilient material of the pair of end plugs 116 and 118 acting to expand and seal the passages 128 and 130 upon an arc burning away the material of the fuse filament into passages 128 and 130.

Figure 6:
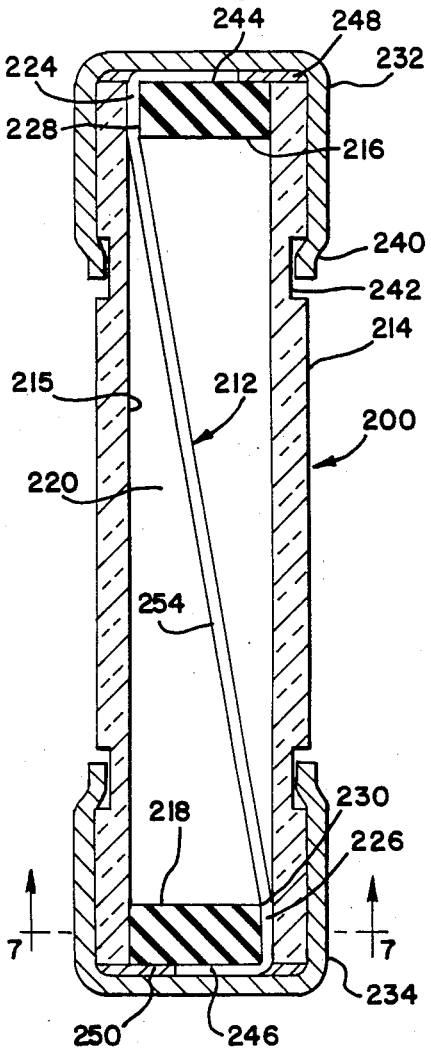
FIG. 6 is a median sectional view of a cartridge fuse constructed and arranged according to a third preferred diagonal filament species of the invention.
Figure 7:
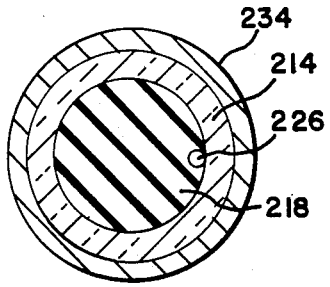
FIG. 7 is a sectional view taken the line 7—7 of FIG. 6 and in the direction indicated by the arrows.

In FIGS. 6 and 7, the invention presents another alternative species in the structure of cartridge fuse 200. Fuse 200 comprises a fuse filament 212 angularly disposed in a cylindrical fuse housing 214. The interior surface 215 of housing 214 defines a central linear passageway 220 having two ends in which are secured a pair of resilient cylindrically configured end plugs 216 and 218. Plugs 216 and 218 are secured in housing 214 by any means desired, such as by compression of the material thereof, gluing, etc.

The ends 224 and 226 of the fuse filament 212 are held captively secured between the exterior surfaces 228 and 230 of the plugs and the interior surface 215 of housing 214 by the resilient lateral compression of the plug material engaging against the fuse ends for an appreciable length thereof. The compression of the fuse filament ends 224 and 226 is used to maintain a light tension along the length of fuse filament 212 between plugs 216 and 218. Two cup-like, cylindrical conducting end terminal caps 232 and 234 are secured to the housing 214 by a mechanical engagement of shoulders 240 and retaining grooves 242.

The ends 224 and 226 of fuse filament 212 pass through between the plug surfaces 228 and 230 and housing surface 215 and terminate in tips 244 and 246 folded at right angles over the outer surfaces of plugs 216 and 218. End caps 232 and 234 close the ends of housing 214 to leave small chambers 248 and 250 that are filled with solder to connect electrically the fuse filament tips 244 and 246 to the end caps 232 and 234.

This embodiment retains the fuse filament 212 angularly aligned along the linear passageway 220 and sealed by end plugs 216 and 218. The end plugs pressing the fuse filament ends 224 and 226 laterally against housing surface 115 also provide the total tensile support for the central region 254 of the fuse filament. The fuse tips 244 and 246 are contained in the chambers 248 and 250 during the end cap attachment process and thus the arrangement avoids placing undue stress on the fuse element during the lead attachment process. This improves manufacturing yields and preserves a high degree of alignment. The space in passageway 220 between the end plugs 216 and 218 can be filled as desired.

Again, the substantially increased protection against explosion is obtained in the arrangement of fuse 200 by the resilient material of the end plugs 216 and 218 acting to expand and seal the spaces between the exterior plug surfaces 228 and 230 and the surface 215 of housing 214 of the fuse filament below the level of the plugs 216 and 218. Effectively, the plug material seals off the space vacated by the burned out length of fuse filament material by engaging with housing surface, 215.

There has thus been described a cartridge fuse design resulting in a fuse having greatly improved explosion resistance under high power dissipation arcing conditions. Additionally, this explosion resistance is provided with a central fuse element disposed axially in a fuse body passage to provide more uniform blowing properties than is conventionally encountered with a diagonal fuse element, and also is provided in a fuse having a diagonal fuse element. In either case, the invention provides low stress attachment means for attaching the fuse element ends or tips to the fuse element terminals. The fuse structure is simple and inexpensive, and lends itself readily to mass fabrication techniques requiring no delicate fuse element attachment or end terminal attachment processes requiring delicacy of alignment or tension. In particular, the resulting cartridge fuses having a pair of seal-off-insulating plugs at both ends result in a fuse of reasonable length capable of withstanding very high short circuit currents without undergoing explosive disintegration.

While the invention has been particularly shown and described with reference to a preferred embodiment thereof, it will be understood by those skilled in the art that various changes in the form and details may be made therein without departing from the spirit and scope of the invention.

I claim:

1. An electrical cartridge fuse comprising:

a housing made of insulating material and having a fuse filament receiving passageway therethrough, said passageway being rectilinear and having opposed ends opening to the exterior of said housing;

a fuse filament longitudinally disposed within said passageway in spaced relation to the central portion of said housing and having opposed ends opening to the exterior of said housing;

a fuse filament longitudinally disposed within said passageway in spaced relation to the central portion of said housing and having opposed ends extending to the opposite ends of said passageway; and a pair of compressible resilient solid plug members made of insulating material of an axial length at least several times the transverse dimension of the fuse filament, said plug members being secured at the opposed ends of said passageway and being resiliently laterally compressed against an axial length of the opposed ends of said fuse filament at least several times the transverse dimensions of the fuse filament captively to secure said fuse filament in said housing under a desired axial tension and wherein, upon an arc forming and burning away material of the fuse filament portion adjacent thereto, the plug members will move into the space vacated by the burned away fuse filament material to quench the arc and;

end terminals closing off the ends of said passageway and electrically connected to the ends of said fuse filament.

2. An electrical cartridge fuse comprising:

a housing made of insulating material and having a fuse filament receiving passageway therethrough, the passageway having opposed ends opening to the exterior of said housing;

a fuse filament longitudinally disposed and centered within said passageway in spaced relation to said housing and having opposed ends extending to the opposed ends of said passageway;

end terminals closing off the ends of said passageway and electrically connected to the ends of said fuse filament; and a pair of resilient solid plug members of an axial length at least several times the transverse dimensions of the fuse filament, said members having passages therethrough with the ends of said fuse filament passing through said passages axially to align said fuse element in said passageway, said resilient members being secured in the hosuing at the opposed ends of said passageway and being resiliently, laterally compressed around an axial length of the opposed ends of said fuse filament of an axial length at least several times the transverse dimensions of the fuse filament, captively to center and secure said fuse filament in said housing under axial tension and wherein upon an arc forming and burning away material of the fuse filament portion adjacent thereto, the plug members will move into the space vacated by the burned away fuse filament material to quench the arc.

3. The fuse of claim 1 wherein each of said end caps has a passage extending therethrough and communicating with the adjacent end of said passageway, each end of said fuse filament passing through a respective end cap passage and being mechanically and electrically connected to the outer face of the associated end cap.

4. The electrical fuse of claims 1 or 2 wherein each of said resilient members is a solid plug that is forced fit into said fuse housing passageway.

5. The fuse of claims 1, 2 or 3 wherein said fuse housing and said passageway therein are coaxial and cylindrical, said resilient members are solid cylindrical plugs within and sealing off the opposed ends of said passageway, and said end terminal members are cylindrical members enveloping the end portions of said housing.

* * * * *